US010133288B2

(12) United States Patent
Fang et al.

(10) Patent No.: US 10,133,288 B2
(45) Date of Patent: Nov. 20, 2018

(54) CIRCUIT FOR LOW-DROPOUT REGULATOR OUTPUT

(71) Applicant: Synopsys, Inc., Mountain View, CA (US)

(72) Inventors: Wen Fang, San Jose, CA (US); Chinh Vo, San Jose, CA (US)

(73) Assignee: Synopsys, Inc., Mountain View, CA (US)

( * ) Notice: Subject to any disclaimer, the term of this patent is extended or adjusted under 35 U.S.C. 154(b) by 0 days.

(21) Appl. No.: 15/283,232

(22) Filed: Sep. 30, 2016

(65) Prior Publication Data

US 2018/0095489 A1 Apr. 5, 2018

(51) Int. Cl.
*G05F 1/575* (2006.01)

(52) U.S. Cl.
CPC ..... *G05F 1/575* (2013.01)

(58) Field of Classification Search
CPC ..... G05F 1/575
See application file for complete search history.

(56) References Cited

U.S. PATENT DOCUMENTS 5,864,227 A * 1/1999 Borden ..... G05F 3/247 323/280
2002/0130646 A1* 9/2002 Zadeh ..... G05F 1/575 323/275
2008/0007231 A1* 1/2008 Maige ..... G05F 1/575 323/225
2008/0094045 A1* 4/2008 Lin ..... G05F 1/56 323/274
2008/0203983 A1* 8/2008 Lo Lacono ..... G05F 1/565 323/266
2008/0224679 A1* 9/2008 Sahni ..... G05F 1/575 323/284
2012/0176107 A1* 7/2012 Shrivas ..... G05F 1/575 323/271
2013/0265020 A1* 10/2013 Krenzke ..... G05F 1/56 323/273
2014/0117952 A1* 5/2014 Li ..... G05F 1/565 323/271

* cited by examiner

*Primary Examiner* — Adolf Berhane
*Assistant Examiner* — Bart Iliya
(74) *Attorney, Agent, or Firm* — Fenwick & West LLP

(57) ABSTRACT

An output circuit at the output of an LDO regulator has two FETs (Field-Effect Transistors), a current source and a capacitor. The first FET is connected to the LDO output and a second voltage supply. The second FET is connected in series with the current source between the LDO output and the second voltage supply. The second FET is connected to the first FET in such a matter that a bias voltage is supplied to the first FET so that in static conditions the first FET draws predetermined amounts of current from the LDO output and to divert the predetermined amounts of current to the LDO output or to draw additional amounts of current from the LDO output to compensate for transient currents on the LDO output and to reduce variations in the output voltage of the LDO regulator. The capacitor with the current source defines a time constant to control the recovery of the output circuit from sudden drops or rises in voltage at the LDO regulator output to allow the LDO regulator to respond without adverse effect to the LDO output voltage.

19 Claims, 2 Drawing Sheets

Conventional LDO using PMOS transistor as regulator

Conventional LDO using NMOS transistor as regulator

CIRCUIT FOR LOW-DROPOUT REGULATOR OUTPUT

BACKGROUND OF THE INVENTION

This invention relates to low-dropout voltage regulators and to circuits for improving the response of a low-dropout voltage regulator to variations in the load of the regulator.

Some circuits need to be operated with a constant voltage to provide a reference voltage or a stable operation supply voltage. The low-dropout voltage regulator, typically called LDO, is usually designed for this case when the load current varies. The LDO regulator is a linear regulator with a low dropout, i.e., the minimum voltage required across the regulator to maintain a regulated output voltage. Like the standard regulator, the LDO regulator has a pass element which is connected between the input and output terminals of the regulator. The input voltage to the regulator minus the voltage drop across the pass element is the output voltage. In the case of the LDO regulator, the voltage drop is small (i.e., low), less than a few hundred mV, say 300 mV, and may be less than 100 mV. The conventional LDO regulator has basically a PMOS FET (P-type Metal-Oxide-Semiconductor Field-Effect Transistor) for a pass element and a feedback amplifier connected to control the PMOS FET. The amplifier has one of its input terminals connected to the LDO output and a second input terminal connected to some reference voltage. The output terminal of the amplifier is connected directly or indirectly, to the gate of the PMOS FET.

The LDO regulator is used in many applications and can be part of an integrated circuit or as an integrated circuit itself. But the LDO regulator has limitations. For example, the response of the LDO regulator may not be as fast as required for certain applications. The regulator may not be able to handle sudden variations in the load current with resulting variations in the voltage at the LDO regulator output.

Therefore what is needed is an efficient and economical way of addressing variations in the load current and keeping the output voltage of the LDO regulator constant.

BRIEF SUMMARY OF THE INVENTION

The present invention provides for a circuit at an output of an LDO (low-dropout) regulator wherein an input of the regulator is connected to a first voltage supply and the output is connected to an output load of the regulator. The circuit comprises a first FET (Field-Effect Transistor) connected to the LDO output. The first FET in static conditions draws predetermined amounts of current from the LDO output and responsive to sudden voltage drops at the LDO output, diverts the predetermined amounts of current to the LDO output immediately to increase the current supply on the LDO output. Furthermore, responsive to sudden voltage rises at the LDO output, the first FET draws additional amounts of current from the LDO output immediately to decrease the current on the LDO output. In this manner transient currents on the LDO output are compensated for and variations in the output voltage of the LDO regulator are reduced.

The present invention also provides for an integrated circuit having an LDO (low drop-out) regulator circuit and an additional circuit at the LDO regulator output. The LDO (low drop-out) regulator circuit comprises: an PMOS FET (Field-Effect Transistor) pass element which has a source connected to an input of LDO regulator and a drain connected to the output of the LDO regulator; and a feedback amplifier having its output connected to the gate of the PMOS FET, with a first input connected to the LDO regulator output directly or indirectly by a resistor divider, and a second input connected to a reference voltage. The additional circuit at the LDO regulator output comprises: a current source having a first terminal and a second terminal connected to a bias generation circuit; a first PMOS transistor having a source connected to the LDO regulator output, a drain connected to the voltage node and a gate; and a second PMOS transistor having a source connected to the LDO regulator output, a drain connected to the first terminal of the current source and a gate connected to the gate of the first PMOS transistor and the drain to form a diode-connected bias circuit. Current through the second PMOS transistor sets the current of the first PMOS transistor in static conditions, with the first PMOS transistor drawing predetermined amounts of current from the LDO output. Responsive to voltage drops at the LDO output due to sudden load current increases, the first PMOS transistor diverts the predetermined amounts of current to the LDO output to increase the immediate current supply on the LDO output, and responsive to voltage rises at the LDO output due to sudden load current reductions, the first PMOS transistor draws additional amounts of current immediately from the LDO output to decrease the current on the LDO output whereby variations in the output voltage of the LDO regulator due to fast load current transients are reduced.

The present invention further provides for a method of operation of a circuit at the output of a low-dropout (LDO) regulator, the output terminal for connection to the output load of the LDO regulator. The method comprises: drawing predetermined amounts of current from the LDO regulator output in static conditions; responsive to sudden drops in voltage at the LDO regulator output, diverting the predetermined amounts of current to the LDO regulator output to increase the current supply on the LDO output; and responsive to sudden rises in voltage at the LDO regulator output, drawing additional amounts of current from the LDO output to compensate for the decrease of the load current on the LDO regulator output; whereby transient currents on the LDO regulator output are compensated for and variations in the voltage of the LDO regulator output are reduced.

Other objects, features, and advantages of the present invention will become apparent upon consideration of the following detailed description and the accompanying drawings, in which like reference designations represent like features throughout the figures.

DETAILED DESCRIPTION OF THE INVENTION

As described earlier, response of the LDO regulator may not be as fast as required in some applications. For example, the response of LDO regulator cannot be as fast as digital logic due to multi-gain stage feedback loop of the LDO. The high gain 2-pole system used in LDO regulator needs a dominant pole much lower than the non-dominant pole. Therefore, the LDO regulator cannot respond to instant current demands of digital logic circuits. As a result, the output voltage dips when the output current surges. In some applications, such as in an integrated circuit with anti-fuse OTP (One Time Programming) memory cells, the data in the cells should be read in less than 40 ns or less. In such a case, the response of LDO to the load current variation is too slow and may cause a failure in a read operation due to LDO output voltage fluctuations.

Figure 1A:
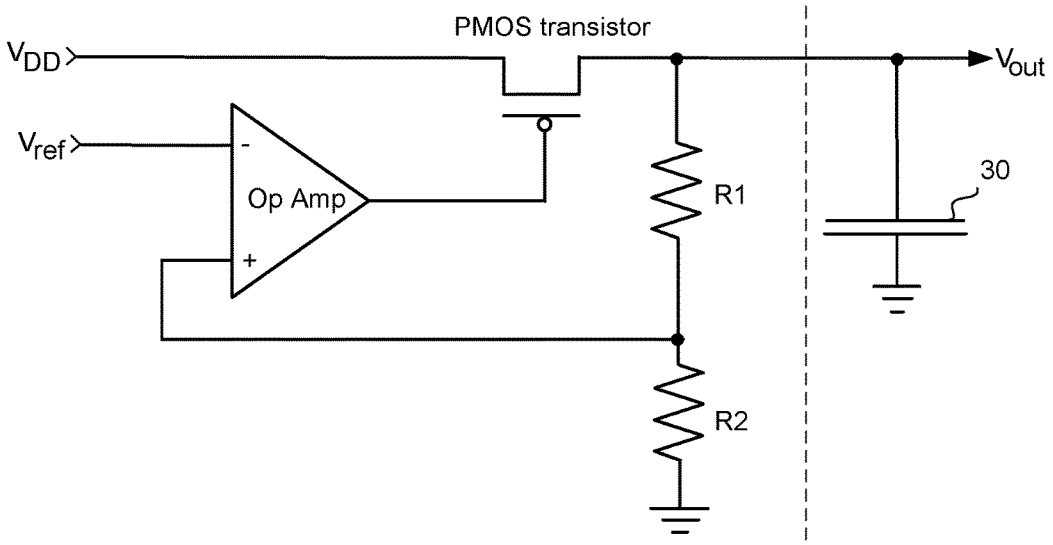
FIG. 1A shows a conventional LDO with a PMOS transistor as a pass element with a large capacitor at the output of the LDO.

In such a case, there are ways to prevent LDO output voltage dipping due to the sudden output current increase. One way is to add a large capacitor to the output of LDO as illustrated in FIG. 1A. A conventional LDO with a PMOS-FET (P-type Metal-Oxide-Semiconductor FET, or PMOS for short) transistor as the pass element connecting to an input voltage at supply voltage $V_{DD}$ is shown to the left of the vertical dotted line; the large capacitor 30 connected to the output line of the LDO is shown to the right of the vertical dotted line. The capacitor 30 provides an instant transient current to the output load if it is large enough as shown in FIG. 1A. However, an on-chip capacitor cannot be designed large enough for the requirement above since a typical integrated circuit capacitance density (usually less than 5 fF/um$^2$) is too low to be effective. On the other hand, an off-chip filter capacitor external to the integrated circuit can be made large enough. This external capacitor can provide instant transient current to LDO output load and prevent LDO output voltage from dipping. But an additional pin to the integrated circuit is needed and undesirably increases the pin count of the integrated circuit and raises packaging costs.

Figure 1B:
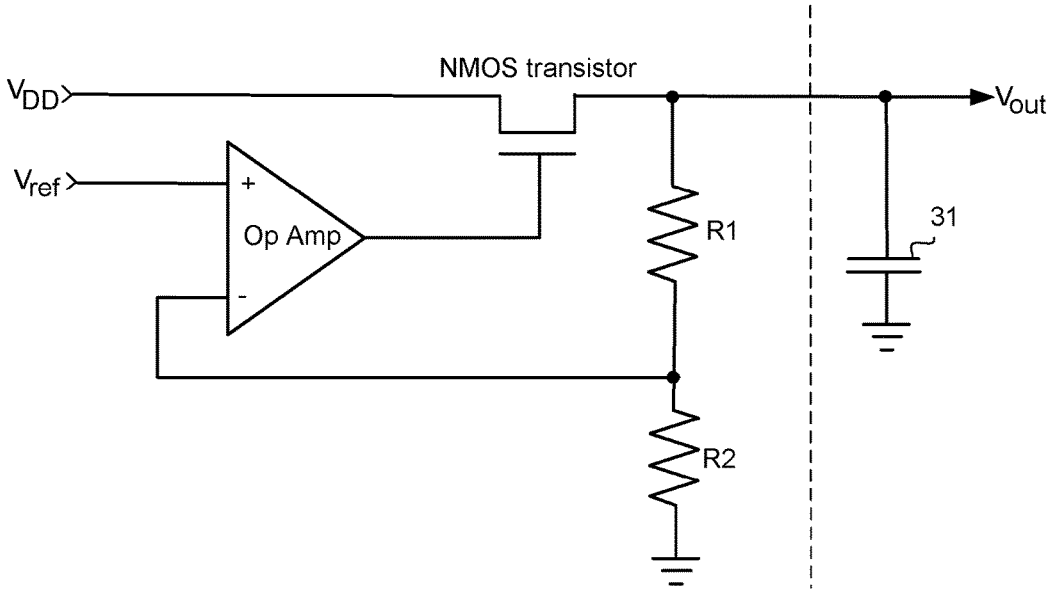
FIG. 1B shows a conventional LDO with a NMOS transistor as the pass element of the LDO.

Another way to prevent the LDO output voltage dipping from the sudden output current increase is to use an NMOS (N-type Metal-Oxide-Semiconductor FET, or NMOS for short) transistor source follower as a pass element as shown in FIG. 1B. A load capacitor 31 shown in FIG. 1B can be much smaller than the capacitor 30 in FIG. 1A. The NMOS source follower has low output impedance characteristics and therefore can prevent the LDO output voltage from dipping too much when the output current sudden increases. However, such a circuit requires a relatively high voltage drop in order to work due to the fact that the gate voltage of the NMOS transistor must be higher than $V_{out}$ by $V_{th}$, the threshold voltage of the NMOS transistor, as compared to an LDO with a PMOS transistor as the pass element. In addition, the source of the NMOS transistor connected to the output of the LDO regulator, and therefore the $V_{th}$ of the NMOS transistor is even higher due to a body effect. Although the threshold voltage $V_{th}$ of the NMOS transistor can be reduced by connecting its body to the source using a deep N-Well structure or selecting a native $V_{th}$ device, such measures undesirably increase costs by adding more mask layers for manufacturing the transistor.

Figure 2:
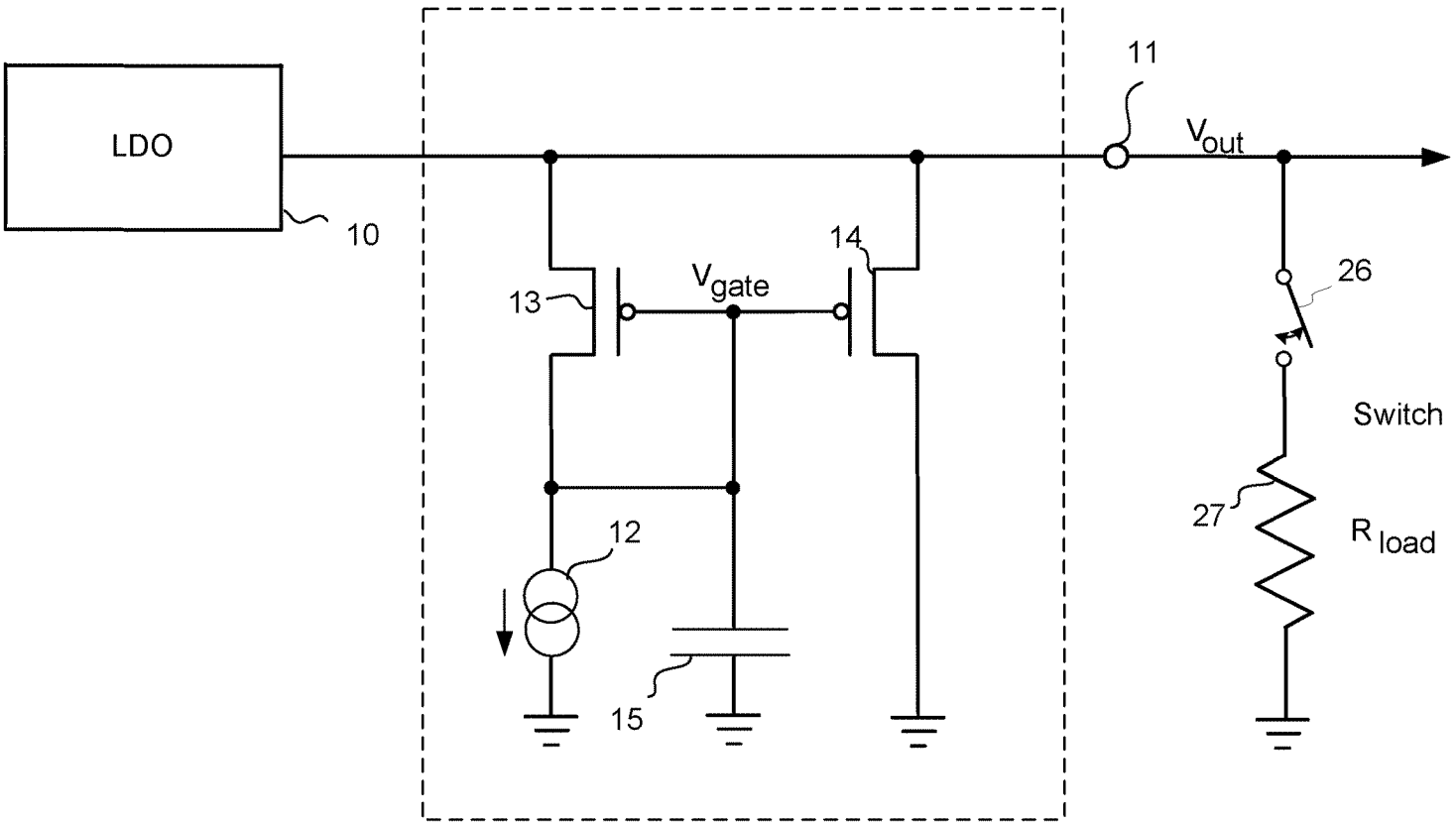
FIG. 2 shows a circuit at the output of a conventional LDO according to one embodiment of the present invention.

The present invention uses a simple and effective circuit to provide compensation for transient currents and to reduce sudden voltage variations on the LDO output. One embodiment of the present invention is illustrated in FIG. 2. The circuit, enclosed by a dotted rectangle, is connected to the output of a conventional LDO regulator 10, such as shown in FIG. 1A, which operates with a PMOS transistor as regulator. This embodiment has a current source 12 to set the bias current of PMOS transistor 13, which is diode-connected to generate bias, another PMOS transistor 14, and a small capacitor 15 connected to both gates of the PMOS transistors 13 and 14. The current source 12 can be implemented easily with a simple NMOS transistor with a bias voltage from the LDO regulator. The drain of the PMOS transistor 13 is connected to a terminal of the current source 12 which has its second terminal connected to ground. The source of the PMOS transistor 13 is connected to LDO output terminal 11. The second PMOS transistor 14 has a source/drain terminal, the source, connected to the LDO output terminal 11 and its second source/drain terminal, the drain, connected to ground. The gate terminals of both PMOS transistors 13 and 14 are connected together, and to ground through the capacitor 15.

Under the expected static conditions, the current source 12 sets a small current for the diode-connected PMOS transistor 13 to generate the bias voltage for the PMOS transistor 14 so that the transistor 14 draws a certain amount of current to ground. The sizes of the PMOS transistors 13 and 14 are designed such that the current of PMOS transistor 14 is comparable to a sudden transient current variation expected while the LDO regulator is in operation. Capacitor 15 can be implemented easily using a NMOS transistor with the gate as the top plate of the capacitor and its source and drain terminals tied together to ground. The size of the capacitor 15 and current source 12 set the time constant to be just long enough to hold the voltage $V_{gate}$ at the gates of the PMOS transistors 13 and 14 relatively stable when LDO output transient current occurs. For the requirement of a LDO regulator to permit the reading of the OTP cells in a memory in 40 ns or less described above, one example of the parameters of the elements of the output circuit are: current source=4 μA, $I_{ds,13}$=4 μA, $I_{ds,14}$=100 μA comparable to the current variation expected, and the capacitor 15 formed by a NMOS transistor with its gate area larger than the total gate areas of the PMOS transistors 13 and 14.

In the embodiment illustrated in FIG. 2, the switch 26 and resistor 27 illustrate variations in the load current for the LDO regulator in operation and further illustrate the responsive actions of the described circuit. If the load switch 26 turns on, a transient current flows out of LDO output into the load resistor 27 with resistance $R_{load}$. This sudden current increase causes the LDO output voltage $V_{out}$ to dip. The sudden voltage dip of $V_{out}$ temporarily turns off the PMOS transistors 13 and 14 by dropping the transistor gate-source voltage $|V_{GS}|$. The current that had been drawn by the PMOS transistor 14 to ground is now diverted to the LDO output with the PMOS transistor 14 switched off. Since the PMOS transistor 14 current is sized to divert current comparable to the expected transient current for the LDO, the current used to be diverted by the PMOS transistor 14 now goes to the resistor load 27 via the switch 26. As a result, the voltage dip at the output of LDO is much less than if the LDO were without the described circuit; the LDO output sees less current variation than without the circuit.

After the load switch 26 is turned on, the current of current source 12 has no way to go but to discharge the capacitor 15. Since the time constant for the current source 12 and capacitor 15 is long, the decrease of $V_{gate}$ is relatively slow and can be tracked and compensated for by the LDO feedback system. The gradual $V_{gate}$ decrease turns on the PMOS transistors 13 and 14 and slowly increases the current through the transistors 13 and 14. However, since the time constant is relatively long and can be tracked by the LDO feedback system, there is no any adverse effect on the LDO output voltage. The output voltage of the LDO regulator 10 recovers precisely as described earlier and the PMOS transistor 14 diverts a current equivalent to the expected transient current to the ground for the next time the load on the regulator 10 switches as represented by the toggle of the switch 26.

If the load on the LDO regulator 10 changes as if the representative switch 26 were turned off, then the LDO output current decreases suddenly and the LDO output voltage $V_{out}$ rises quickly. Since the voltage $V_{gate}$ at the gates of the PMOS transistors 13 and 14 is relative constant due to the capacitor 15, the $|V_{GS}|$ of both transistors increases and the currents through both PMOS transistors 13 and 14 increase. The sudden current increase of PMOS transistor 14 cancels some of the effect caused by the decrease in the load current seen by the LDO regulator 10 and therefore the amount of voltage rise is less than if the described circuit were not there. The current increase through the PMOS transistor 13 at that time charges the capacitor 15. Again, since the charging time constant for the constant current source 12 and the capacitor 15 is relatively long and can be tracked by LDO feedback system, there is no any adverse effect on the LDO output voltage during this period and the LDO output voltage remains stable. The LDO regulator recovers its output voltage precisely as described before and the PMOS transistor 14 siphons off the expected transient current to the ground again for the next time the load on the regulator 10 switches as represented by the toggle of the switch 26.

From the description above a simple and effective circuit which reduces LDO output current sudden variations and therefore decreases the voltage fluctuations on LDO output during the transient conditions is presented. The circuit is very useful in reducing LDO output voltage fluctuation in cases when a low threshold voltage $V_{th}$ NMOS transistor device or an off-chip external filter capacitor is too costly or unavailable. The circuit has four small silicon devices, a current source, two PMOS transistors and a capacitor which can all be made from conventional CMOS transistors using standard CMOS manufacturing processes. The only cost compared to other solutions is a small current which is diverted to ground in normal operation and having a magnitude that is comparable to the sudden transient load variations. There are many cases where analog circuits need this apparatus to improve LDO settling time and reduce output voltage fluctuation. Furthermore, with appropriate adjustments other types of FETs, such as JFETs (Junction FETs) may be adapted for this circuit.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A circuit at an output of a low-dropout (LDO) regulator, the circuit comprising:

a first transistor having a first terminal connected to the output of the LDO regulator, a second terminal coupled to a first voltage supply, and a gate terminal connected to the second terminal; and a second transistor having a first terminal connected to the first terminal of the first transistor, a second terminal connected to the first voltage supply, and a gate terminal connected to the gate terminal of the first transistor, wherein:

responsive to a voltage at the output of the LDO regulator remaining constant, first current set by current through the first transistor flows from the output of the LDO regulator to the second transistor, responsive to a decrease in the voltage at the output of the LDO regulator, the second transistor is turned off and the first current is diverted from the second transistor to the output of the LDO regulator, and responsive to a rise in the voltage at the output of the LDO regulator second current in addition to the first current flows from the output of the LDO regulator to the second transistor.

2. The circuit of claim 1, wherein an amount of current flowing from the output of the LDO regulator to the second transistor increases over a time period, after the first current is diverted to the output of the LDO regulator responsive to the decrease in the voltage at the output of the LDO regulator.

3. The circuit of claim 1, wherein an amount of current flowing from the output of the LDO regulator to the second transistor decreases over a time period, after the second current in addition to the first current flows from the output of the LDO regulator responsive to the rise in the voltage at the output of the LDO regulator.

4. The circuit of claim 1, further comprising:

a current source connected in series with the first transistor to generate a bias voltage for the second transistor, the current source further connected to the gate terminal of the second transistor, and when the second transistor turns on the first current set by the current source flows from the output of the LDO regulator to the second transistor.

5. The circuit of claim 1, wherein a size of the second transistor relative to a size of the first transistor is such that the second transistor has capacity to receive the first current from the output of the LDO regulator when the voltage at the output of the LDO regulator remains constant.

6. The circuit of claim 1, further comprising:

a capacitor having a first terminal connected to a first voltage supply and a second terminal connected to the gate terminals of the first and second transistors, the capacitor defining a time constant with the current through the first transistor such that an amount of current flowing from the output of the LDO regulator to the second transistor increases over a first time period, after the first current is diverted to the output of the LDO regulator responsive to the decrease in the voltage at the output of the LDO regulator, and an amount of current flowing from the output of the LDO regulator to the second transistor decreases over a second time period, after the second current in addition to the first current flows from the output of the LDO regulator responsive to the rise in the voltage at the output of the LDO regulator.

7. The circuit of claim 6, wherein an input of the LDO regulator is connected to a second voltage supply being at a higher voltage than the first voltage supply.

8. The circuit of claim 1, wherein each of the first and second transistors comprises a P-type Metal-Oxide-Semiconductor (PMOS) transistor.

9. An integrated circuit comprising:

a low drop-out (LDO) regulator comprising:

a transistor pass element having a first terminal connected to an input of the LDO regulator and a first voltage supply and a second terminal connected to an output of the LDO regulator, and a feedback amplifier for controlling the transistor pass element, the feedback amplifier having a first input connected to the output of the LDO regulator, a second input connected to a reference voltage, and an output connected to a gate of the transistor pass element; and a circuit at the output of the LDO regulator, the circuit comprising:

a first transistor having a first terminal connected to the output of the LDO regulator, a second terminal coupled to a second voltage supply, and a gate terminal connected to the second terminal, and a second transistor having a first terminal connected to the first terminal of the first transistor, a second terminal connected to the second voltage supply, and a gate terminal connected to the gate terminal of the first transistor, wherein:

responsive to a voltage at the output of the LDO regulator remaining constant, first current set by current through the first transistor flows from the output of the LDO regulator to the second transistor, responsive to a decrease in the voltage at the output of the LDO regulator, the second transistor is turned off and the first current is diverted from the second transistor to the output of the LDO regulator, and responsive to a rise in the voltage at the output of the LDO regulator, second current in addition to the first current flows from the output of the LDO regulator to the second transistor.

10. The integrated circuit of claim 9, wherein a size of the second transistor relative to a size of the first transistor is such that the second transistor has capacity to receive the first current from the output of the LDO regulator when the voltage at the output of the LDO regulator remains constant.

11. The integrated circuit of claim 9, wherein the circuit at the output of the LDO regulator further comprises:

a capacitor having a first terminal connected to the second voltage supply and a second terminal connected to the gate terminals of the first and second transistors, the capacitor defining a time constant with the current through the first transistor such that an amount of current flowing from the output of the LDO regulator to the second transistor increases over a first time period, after the first current is diverted to the output of the LDO regulator responsive to the decrease in the voltage at the output of the LDO regulator, and an amount of current flowing from the output of the LDO regulator to the second transistor decreases over a second time period, after the second current in addition to the first current flows from the output of the LDO regulator responsive to the rise in the voltage at the output of the LDO regulator.

12. The integrated circuit of claim 11, wherein an input of the LDO regulator is connected to the first voltage supply being at a higher voltage than the second voltage supply.

13. The integrated circuit of claim 11, wherein the second voltage supply is at ground.

14. The integrated circuit of claim 9, wherein each of the first and second transistors comprises a P-type Metal-Oxide-Semiconductor (PMOS) transistor.

15. A method of operation of a circuit at the output of a low-dropout (LDO) regulator, the method comprising:

receiving, responsive to a voltage at an output of the LDO regulator remaining constant, first current from the output of the LDO regulator set by current through a first transistor having a first terminal connected to the output of the LDO regulator, a second terminal coupled to a first voltage supply and a gate terminal connected to the second terminal;

responsive to a decrease in the voltage at the output of the LDO regulator, diverting the first current from a second transistor being turned off to the output of the LDO regulator, the second transistor having a first terminal connected to the first terminal of the first transistor, a second terminal connected to the first voltage supply, and a gate terminal connected to the gate terminal of the first transistor; and responsive to a rise in the voltage at the output of the LDO regulator, receiving second current from the output of the LDO regulator in addition to the first current.

16. The method of claim 15, further comprising:

generating a bias voltage with the first transistor and a current source connected in series with the first transistor and supplying the current through the first transistor, the bias voltage causing the second transistor to receive the first current from the output of the LDO regulator.

17. The method of claim 15, wherein a size of the second transistor relative to a size of the first transistor is such that the second transistor has capacity to receive the first current from the output of the LDO regulator when the voltage at the output of the LDO regulator remains constant.

18. The method of claim 15, further comprising:

increasing, over a first time period, an amount of current received from the output of the LDO regulator after diverting the first current to the output of the LDO regulator responsive to the decrease in the voltage at the output of the LDO regulator; and decreasing, over a second time period, an amount of current received from the output of the LDO regulator after receiving the second current from the output of the LDO regulator responsive to a rise in the voltage at the output of the LDO regulator.

19. The method of claim 15, further comprising:

generating a bias voltage with the first transistor and a current source connected in series with the first transistor and supplying the current through the first transistor, the bias voltage causing the second transistor to receive the first current from the output of the LDO regulator; and defining a circuit time constant with the current source and a capacitor connected in parallel with the current source.

* * * * *